United States Patent [19]

Nordgren et al.

[11] 4,036,143

[45] July 19, 1977

[54] IMPACT CONTACT DEVICE FOR PROJECTILES

[75] Inventors: John Lennart Nordgren; Gunnar Gudmund Thordarson, both of Jarfalla, Sweden

[73] Assignee: U.S. Philips Corporation, New York, N.Y.

[21] Appl. No.: 668,087

[22] Filed: Mar. 18, 1976

[30] Foreign Application Priority Data

Mar. 26, 1975 Sweden ..... 7503490

[51] Int. Cl.[2] ..... F42C 19/06

[52] U.S. Cl. ..... 102/70.2 R; 102/73 A

[58] Field of Search ..... 102/70.2 R, 73 R, 73 A

[56] References Cited

U.S. PATENT DOCUMENTS 3,158,705 11/1964 Bliss ..... 102/70.2 R 3,783,791 1/1974 Backstein et al. ..... 102/70.2 R 3,793,956 2/1974 Nordgren ..... 102/70.2 R

FOREIGN PATENT DOCUMENTS 693,107 8/1964 Canada ..... 102/70.2 R

*Primary Examiner*—Charles T. Jordon

*Attorney, Agent, or Firm*—Frank R. Trifari

[57] ABSTRACT

An impact contact for ignition tubes mounted on the nose of a projectile and consisting of two substantially rigid parts held together by mechanical fastening means which can yield due to lateral forces acting on the front part. Contact means are arranged at the place of interconnection between the two parts, which contact means are sensitive to a relative motion, in a lateral or axial direction, between the two parts for initiating a burst at a value of said relative motion exceeding a certain value.

4 Claims, 5 Drawing Figures

IMPACT CONTACT DEVICE FOR PROJECTILES

Figure 1:
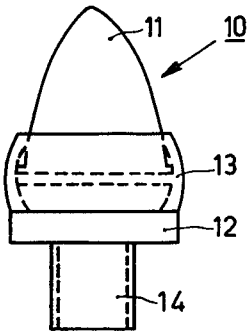

The invention relates to an impact contact device in an ignition tube mounted at the nose of a projectile and comprising at least one impact contact adapted to deliver an ignition pulse to an electric igniter included in an ignition circuit for initiating a burst at impact of the projectile against a target.

The impact contact (or contacts) in such ignition tubes is (are) usually substantially only sensitive in the case of hits from the front, i.e. retardation rearwardly as seen in the motion direction of the projectile. The contact may for example be of the inertia type and comprise a movable ball which changes position upon axial retardation and then closes or interrupts a connection, whereby an ignition pulse is generated. These impact contacts operate correctly upon impact at a large angle relative to a target. Then there will be a deformation of the nose part of the ignition tube, where the impact contact is situated, and a pressure wave will propagate to the impact contact or contacts for initiating a burst. In the case of hits against ground targets at small angles, however, such impact contacts have a more unreliable function and it may happen that the ignition circuit is inactivated by lateral deformation or a break before an ignition pulse has been generated.

The invention relates more particularly to ignition tubes which consist of two substantially rigid parts, a front part or nose part and a rear part or base part, which parts are held mechanically together by fastening means, for example a sleeve-shaped ring surrounding the two parts at their area of contact. The fastening means can yield in the lateral direction due to elasticity or break. The two parts may for example be mutually rotatable for setting the tube to different functions by a mutual rotation of the parts.

When a projectile provided with such a two-part ignition tube hits a ground target at a small angle it may occur that the front part, where the normal impact contacts are situated, is broken away from the base part so that the ignition circuit is inactivated by short-circuiting or a break in a connection conductor between the nose part and the base part, i.e. before an ignition pulse can be delivered by the impact contacts situated in the nose part.

In order to eliminate the risk of an erroneous function of the ignition tube in such a case the device according to the invention includes furthermore at least one impact contact, which is situated at the interface between the two parts of the ignition tube and so adapted that it is sensitive to relative motion between the said parts for generating an ignition pulse to the electric igniter at a certain value of the said motion.

A probable relative motion between the two parts of the ignition tube upon impact at a small angle against a target is that the nose part swings relative to the base part about a peripheral point. If the impact contact according to the invention, which is adapted to detect this motion, is situated at a relatively large distance from the said point, about which the part swings, for example at the centre of the tube, the relative motion at the place of the impact contact will consist of a substantially axial displacement of the parts away from each other. The impact contact according to the invention thus in first hand shall be sensitive to an axial displacement of the parts relative to each other.

The impact contact may consist of two contact elements, each arranged on one of the said two parts of the ignition tube, which elements normally are situated at a distance from each other but which, when the ignition tube is broken, will come in touch with each other and then will initiate a burst. One of the contact elements may suitably have the shape of a metallic part projecting from the nose part, for example a metallic sleeve, which extends into a corresponding recess in a metallic plate barrier on the base part. The sensitivity to axial displacement is then achieved by providing the metallic sleeve with radially projecting portions, which, upon axial displacement of the parts relative to each other, will come in touch with contact elements, for example tongues or segments, on the metallic plate projecting into the said recess relative to the wall of the recess.

In certain types of impact the two parts of the ignition tube can be imparted a shearing motion, i.e. lateral displacement, relative to each other. In the described embodiment of the impact contact according to the invention comprising a metallic part projecting from the nose part into a recess in a metallic plate on the base part, sensitivity for such a lateral displacement is automatically achieved in that the metallic part on the nose part will abut the wall of the recess or the projecting contact elements on the base part.

The invention is illustrated in the accompanying drawings, in which

Figure 2:
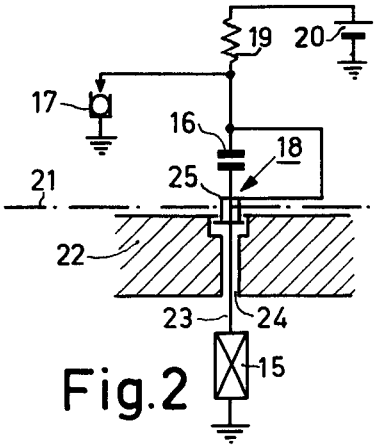
Figure 3:
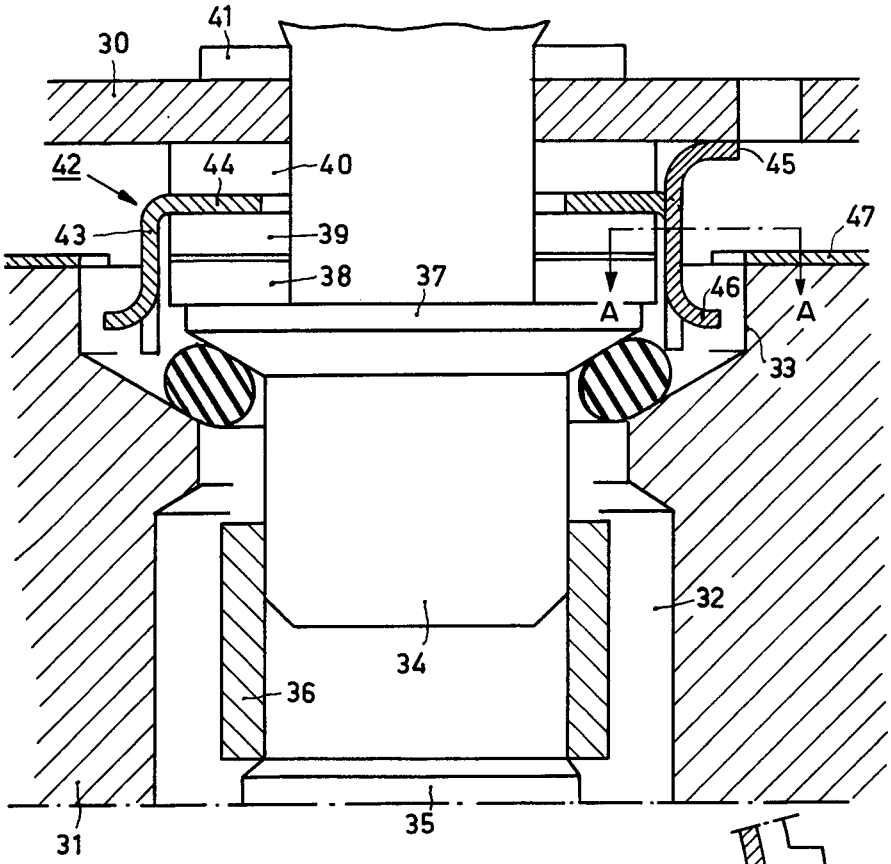
Figure 3A:
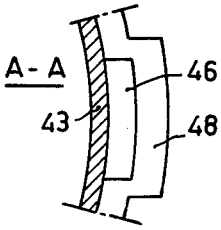
Figure 4:
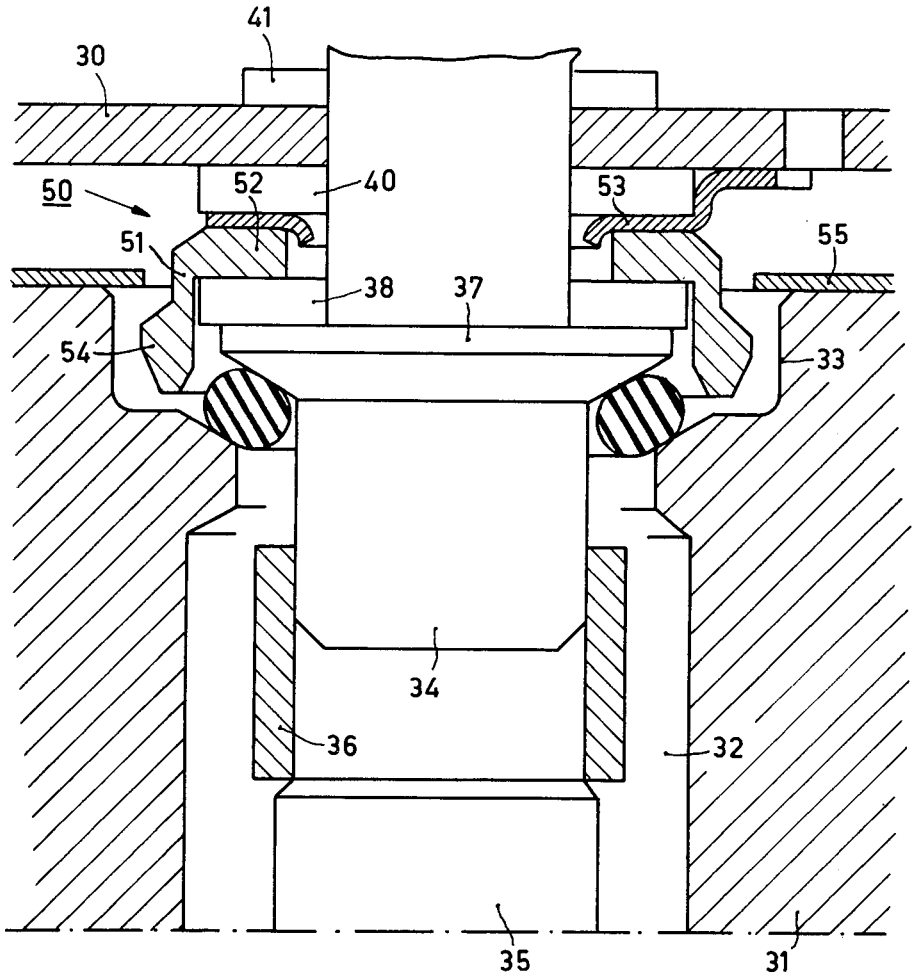

FIG. 1 shows a side view of an ignition tube composed of two parts, in which an impact contact according to the invention may be arranged, FIG. 2 shows a simplified circuit arrangement for an ignition circuit, in which the impact contact according to the invention is included, FIGS. 3 and 4 show in sectional views two different embodiments of the impact contact according to the invention, and FIG. 3*a* shows a sectional view along the lines A—A in FIG. 3.

FIG. 1 shows a side view of an ignition tube 10 consisting of a nose part 11 and a base part 12, which are held together by a metallic sleeve 13. The base part is terminated downwardly by a cylindrical threaded part 14, which is adapted to be screwed into a corresponding aperture in the nose of a projectile. The parts are rotatable relative to each other and mechanically interconnected in a manner as described, for example, in the Swedish Pat. No. 363,894.

FIG. 2 shows a simplified circuit arrangement for an ignition circuit with an impact function 17 and a known impact contact of the inertia type and an impact contact according to the invention. The ignition circuit consists of an electric igniter 15, a capacitor 16 and the two impact contacts 17, 18 of which the first one (17) is the normally used contact of the inertia type and the second one (18) is the new impact contact according to the invention. The elements included in the ignition circuit, i.e. the electric igniter 15, the capacitor 16 and the two impact contacts 17, 18, which are arranged in parallel, are interconnected in a series loop with ground (the metallic shell) as the return conductor. In the operative condition the capacitor is kept continuously charged through a resistance 19 from a battery 20. The charging circuit also comprises, besides the resistance 19 and the capacitor 16, the electric igniter 15. The resistance 19 is then so high that the current pulse arising when the capacitor is initially charged, i.e. upon the activation of the battery, is not able to initiate the electric igniter.

Of the elements included in the ignition circuit, the capacitor 16, the contact 17, the resistance 19 and the acceleration activated battery 20 are all arranged in the nose part 11, while the electric igniter 15 is arranged in the base part 12. The impact contact 18, according to the invention is, as will be described in more detail below, arranged at the interface between the two parts of the ignition tube. The separating line between the nose part and the base part is indicated in FIG. 2 by the line 21. The inner spaces of the two parts 11, 12 are separated from each other by a heavy mechanical barrier 22, which is formed by the upper wall of the base part facing the nose part. The electric connection between the capacitor in the nose part and the electric igniter in the base part is formed by a centrally arranged conductor 23, which extends through a hole 24 in the metallic barrier.

The function upon normal impact of the projectile against a target at a large angle, is that the contact 17 will be closed, so that the capacitor will discharge through the electric igniter, which then will initiate a burst.

However, upon impact against ground targets at a very small impact angle it occurs that the mechanical connection between the nose part and the base part is broken before the inertia contact 17 has been activated. Due to the small dimensions of the hole 24 the central conductor 23 will, even for a very small change in the mutual position of the nose part and the base part, come in touch with the metallic barrier. Then the electric igniter will be short-circuited to ground and the ignition tube is inactivated.

In order to prevent such an unintentional inactivation of the ignition tube the contact 18 is, according to the invention, arranged at the interconnection place between the nose part and the base part. In FIG. 2 the contact 18 is only shown schematically as a metallic sleeve 25 surrounding the central conductor 23, from which it is electrically insulated. The sleeve 25 is mechanically supported from the nose part 11 and is electrically connected to that side of the capacitor, which is facing the charge resistance 19. The sleeve projects into a widened portion of the hole 24 in the metallic barrier and is provided with projecting contact elements which, as will be described more closely in connection with FIGS. 3 and 4, will come in touch with the metallic barrier, i.e. electric ground, when the ignition tube is broken, and before the central conductor comes in touch with ground. When contact arises between the sleeve and ground the ignition circuit will be closed in the same manner as upon closing of the contact 17 and the capacitor will be discharged through the electric igniter, which initiates a burst.

FIG. 3 shows a sectional view through the central portion of the ignition tube at the place of interconnection between the nose part and base part for illustrating a first embodiment of the new impact contact according to the invention. The nose part is downwardly terminated by an insulating contact carrier plate 30, which plate is situated opposite the upper side of the base part 12 shaped as a mechanical barrier 31. The parts can be mechanically joined in the manner as described in the said patent, in which case the contacts supported by the contact plate are included in a functional switch. Centrally through the metallic barrier extends a hole 32, which at the upper part has a widened portion 33. Through this hole extends a central conductor which in the example consists of an upper portion 34 supported by the contact plate 30 and a lower portion 35. The two portions 34 and 35 are interconnected through a sleeve 36.

The portion 34 of the central conductor supported by the contact plate 30 has a flange 37 for fastening the central conductor in the plate. The fastening is achieved in that the upper portion of the part 34 situated above the flange 37 is introduced from below, via a number of washers 38–40, through a central aperture in the contact plate 30 and finally through a washer 41 situated upon the plate 30, whereafter the part projecting through the washer 41 has been deformed so that the washers 38–40 are clamped between the lower side of the contact plate 30 and the flange 37.

The impact contact shown in FIG. 3 has the shape of a metallic sleeve ring 42 consisting of a sleeve-shaped portion 43 and a ring-shaped portion 44. The said ring-shaped portion 44 projects radially inwardly and is clamped between two of the washers 39 and 40, while the axial portion 43 projects downwardly into the widened portion 33 of the hole through the metallic barrier. The inner diameter of the ring 44 is larger than the diameter of the central conductor and the ring is so oriented that it is insulated from the central conductor. A contact tongue 45 is punched from the ring for producing electric connection with the capacitor situated in the nose part.

At the lower portion of the sleeve 43 a number of segments 46 are bent radially outwardly so that they are situated closer to the wall of the recess than the remaining part of the sleeve. The said segments are adapted to cooperate with a contact ring 47 which is fastened to the metallic barrier so that it is in electric contact therewith. The contact ring 47 projects inwardly relative to the wall of the recess and is provided with cut-outs 48, as is shown by a part horizontal view in FIG. 3*a*. The cut-outs 48 have for their purpose to enable assembling of the contact, which is effected in that the outwardly bent segments 46 are introduced through the cut-outs 48. The sleeve 43 with the segments is thereafter rotated relative to the fixed contact ring 47 so that the segments in the mounted condition will be situated opposite inwardly projecting portions of the contact ring 47. Thus, upon an axial displacement of the nose part relative to the base part the said segments will, after a small relative motion, come in touch with the contact ring 47, which is connected to the metallic barrier and forms the electric ground in the ignition circuit. According to the circuit diagram shown in FIG. 2 the ignition circuit is then closed and a burst initiated. Should the nose part instead be displaced transversely relative to the base part, the said contact segments on the sleeve 43 will come in touch with the wall of the recess or the sleeve 43 will come in touch with the contact ring 47 so that a burst is initiated in the described manner, and before the central conductor itself comes in touch with the wall of the recess.

FIG. 4 shows a modification of the impact contact according to the invention, corresponding elements in the two figures being provided with the same reference numerals. As in the foregoing example the impact contact according to the invention, generally designated by reference numeral 50, consists of a sleeve-shaped part 51 and a ring-shaped part 52. The sleeve-shaped part projects downwardly into the recess in the metallic barrier, while the ring-shaped part 52 is clamped between two washers 38, 40. A contact ring 53 for connecting the body 50 to the capacitor of the ignition circuit is clamped between the ring-shaped part 52 and the washer 40. The sleeve-shaped part has projecting portions 54 which are adapted to cooperate with a contact ring 55 placed upon the metallic barrier. The ring 55 may be shaped in the same manner as the corresponding ring in FIG. 3 or only consist of inwardly projecting contact fingers, in which case corresponding grooves are arranged in the projecting portions 54 on the sleeve 51 for allowing assembly of the contact. When the contact has been assembled by bringing the projecting portions on the metallic sleeve 51 through the recesses in the contact ring 55 or vice versa, the metallic sleeve 51 is rotated so that the projecting portions on the metallic sleeve 51 in the mounted condition will be situated opposite the inwardly projecting portions on the contact ring 55. In the case of a relative motion between the nose part and the base part, axially or transversely, the metallic sleeve 51 will come in contact with the metallic barrier of the contact ring 55, so that a burst is initiated before the central conductor comes in contact with the wall of the recess.

A number of modifications of the described embodiments are possible within the scope of the invention. Thus, the impact contact according to the invention does not need a sleeve-shaped ring surrounding the conductor, which interconnects the nose part with the base part and passes the ignition pulse to the electric igniter arranged in the said last part, but may for example comprise a contact pin situated at any place along the interface between the two parts and projecting into a recess in the metallic barrier. Quite different types of contacts are also possible, for example common spring contacts or micro-switches which are actuatable by mechanical motion.

What is claimed is:

1. An impact contact device in an ignition tube adapted to be mounted on the nose part of a projectile, the tube including a rigid nose part and a rigid base part, comprising a rotational joint for mechanically holding together said nose and base parts so as to allow relative rotation of the two parts, said rotational joint being dimensioned so as to have a mechanical strength such that it yields due to resilience or a break when exposed to given forces which appear upon lateral impact of the projectile against a target, contact means arranged at the interface area between the two parts and responsive to a relative motion, in a lateral or axial direction, between the two parts for operating an ignition circuit when said relative motion exceeds a certain value, a portion of the base part that faces the nose part comprising a metallic plate having a central aperture and forming a mechanical barrier between the two parts and an electric ground for the ignition circuit, said contact means comprising a first contact element supported by the nose part and including a generally sleeve-shaped metallic body which projects from the nose part into a recess in said metallic plate, said contact means further comprising a second contact element supported by the base part and electrically connected to the metallic plate and normally positioned at a distance from the first contact element but arranged to come into contact with the first contact element upon relative motion between the nose and base parts thereby to operate said ignition circuit, a conductor extending through said central aperture for interconnecting the nose part and the base part and surrounded by the sleeve-shaped body, said recess in the metallic plate comprising a widened portion of the central aperture which is situated at the surface of the metallic plate that faces the nose part.

2. A device as claimed in claim 1, wherein said second contact element comprises a contact ring conductively connected to the surface of said metallic plate which faces the nose part, said second contact element including contact segments which project in a direction towards the central conductor and, said sleeve-shaped body being provided with projecting portions at least at some places on its periphery for making contact with the said inwardly projecting contact segments upon axial motion between the nose part and the base part, lateral displacement between said parts producing contact either between the said projecting portions and the wall of the recess or between the contact sleeve and the said inwardly projecting contact segments.

3. A device as claimed in claim 1 wherein said rotational joint comprises a ring surrounding the nose and base parts at the interface area and included in a functional switch for presetting the ignition tube to different functions by means of the relative rotation of the nose and base parts.

4. A device as claimed in claim 1 wherein said second contact element comprises a contact ring supported on the metallic plate in the area of said recess, said contact ring and metallic ring together forming said second contact element.

* * * * *

UNITED STATES PATENT AND TRADEMARK OFFICE

CERTIFICATE OF CORRECTION

PATENT NO. : 4,036,143

DATED : July 19, 1977

INVENTOR(S) : JOHN L. NORDGREN ET AL

It is certified that error appears in the above-identified patent and that said Letters Patent are hereby corrected as shown below:

Col. 2, line 48, "17 and a" should be --comprising a--;

Claim 1, line 2, "nose part" should be --nose--;

Claim 2, line 6, "and" should be deleted;

lines 7 and 8, "at least at some places" should be deleted.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*